US009481183B2

(12) United States Patent
Takahashi et al.

(10) Patent No.: US 9,481,183 B2
(45) Date of Patent: Nov. 1, 2016

(54) PRINTER

(71) Applicants: CITIZEN HOLDINGS CO., LTD., Tokyo (JP); CITIZEN SYSTEMS JAPAN CO., LTD., Tokyo (JP)

(72) Inventors: Akira Takahashi, Nagano (JP); Yuichi Taguchi, Nagano (JP)

(73) Assignees: CITIZEN HOLDINGS CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 14/778,905

(22) PCT Filed: Jan. 14, 2015

(86) PCT No.: PCT/JP2015/050814

§ 371 (c)(1),
(2) Date: Sep. 21, 2015

(87) PCT Pub. No.: WO2015/151545

PCT Pub. Date: Oct. 8, 2015

(65) Prior Publication Data

US 2016/0046131 A1 Feb. 18, 2016

(30) Foreign Application Priority Data

Mar. 31, 2014 (JP) ..... 2014-073144

(51) Int. Cl.

| | |
|---|---|
| ***B41J 2/33*** | (2006.01) |
| ***B41J 2/325*** | (2006.01) |
| ***B41J 29/13*** | (2006.01) |
| ***B41J 17/24*** | (2006.01) |
| ***B41J 33/18*** | (2006.01) |
| ***B41J 29/02*** | (2006.01) |
| ***B41J 29/38*** | (2006.01) |

(52) U.S. Cl.

CPC *B41J 2/33* (2013.01); *B41J 2/325* (2013.01); *B41J 17/24* (2013.01); *B41J 29/02* (2013.01); *B41J 29/13* (2013.01); *B41J 29/38* (2013.01); *B41J 33/18* (2013.01)

(58) Field of Classification Search

CPC ..... B41J 29/13; B41J 17/24; B41J 2/325
See application file for complete search history.

(56) References Cited

U.S. PATENT DOCUMENTS

| | | | |
|---|---|---|---|
| 4,768,039 | A | 8/1988 | Akutagawa et al. |
| 5,513,920 | A | 5/1996 | Whritenor et al. |
| 5,562,352 | A | 10/1996 | Whritenor et al. |

FOREIGN PATENT DOCUMENTS

| | | | |
|---|---|---|---|
| EP | 0603499 | A2 | 6/1994 |
| JP | 2001-038995 | A | 2/2001 |

(Continued)

OTHER PUBLICATIONS

Japan Patent Office, Office Action for Japanese Patent Application No. 2014-073144, Mar. 3, 2015.

(Continued)

*Primary Examiner* — An Do
*Assistant Examiner* — Renee I Wilson

(57) ABSTRACT

Provided is a printer in which the rotating shaft of a ribbon roller can be connected to its driving unit with high accuracy by using a mechanism simple in structure, while preventing breakage that may occur when connecting the rotating shaft to the driving unit. The printer (1) includes a cabinet (7), a drawer unit (11) which can be drawn out of the cabinet, a ribbon roller (4A, 4B) on which a belt-like ink ribbon used for transferring to a recording sheet is wound, a driving unit (31A, 31B) which drives the ribbon roller for rotation by being connected to a rotating shaft (14A, 14B) of the ribbon roller when the drawer unit is loaded in the cabinet, and a disengaging member (40) which is provided on the cabinet and which disengages the driving unit from the rotating shaft when the drawer unit is drawn out of the cabinet.

4 Claims, 8 Drawing Sheets

(56) References Cited

FOREIGN PATENT DOCUMENTS

| | | | | |
|---|---|---|---|---|
| JP | 2008-137225 | A | | 6/2008 |
| JP | 2011-110872 | A | | 6/2011 |
| JP | 2011110872 | A | * | 6/2011 |

OTHER PUBLICATIONS

Written Opinion of the International Searching Authority for PCT/JP2015/050814, Mar. 3, 2015.

European Patent Office, Supplementary European Search Report for EP Patent Application No. 15774189.3, Jun. 30, 2016.

* cited by examiner

PRINTER

TECHNICAL FIELD

The present invention relates to a printer that prints an image on a recording sheet by using a belt-like ink ribbon.

BACKGROUND ART

A type of printer is known in which inks of various colors are transferred in a sequentially overlaid fashion from an ink ribbon containing, for example, Y (yellow) ink, M (magenta) ink, C (cyan) ink, an OP (overcoat), etc., onto a recording sheet such as photographic paper by using heat generated by a thermal head. The ink ribbon is a belt-like sheet on which inks of different colors are arranged repeatedly in the same order along its longitudinal direction, and is enclosed in a ribbon cassette by being wound on a ribbon supply roller. When printing, the ink ribbon is fed from the ribbon supply roller toward a ribbon take-up roller by driving the ribbon roller to rotate, and while being transported, the ink ribbon passes the thermal head together with the recording sheet. By transporting the ink ribbon and the recording sheet in synchronized fashion, the inks of the respective colors are transferred in sequence for printing on the same area on the recording sheet.

In this type of printer, the rotating shaft of the ribbon roller is connected to a driving unit to drive the ribbon roller to rotate; since the ribbon roller needs to be removed when replacing the ink ribbon, it is desirable that the ribbon roller be easily disengageable from and connectable to the driving unit.

For example, patent document 1 discloses a printer including an ink ribbon accommodating unit for accommodating an ink ribbon in a rotatable and axially slidable fashion, a driving unit, provided in a printer body, for supplying and rewinding the ink ribbon, and a moving mechanism for moving the ink ribbon inside the ink ribbon accommodating unit in an axially sliding fashion. In this printer, the moving mechanism moves the ink ribbon so as to slide along the axial direction inside the ink ribbon accommodating unit and thereby connects the ink ribbon to the driving unit, and the driving unit is driven to supply and rewind the ink ribbon.

On the other hand, patent document 2 discloses a thermal transfer printer including a unit which is mounted on a shaft so as to straddle a door frame and so as to be slidable along an extending direction of the shaft, and which can be engaged with and disengaged from an ink bobbin by being moved slidably along the shaft and, when engaged, can drive the ink bobbin to rotate, and a pressing member which is provided on a cabinet so as to be able to contact the unit when the door frame is moved from a first position to a second position. In this printer, the unit is engaged with and disengaged from the ink bobbin as the pressing member is brought into contact with and separated from the unit.

PRIOR ART DOCUMENTS

Patent Documents

Patent document 1: Japanese Unexamined Patent Publication No. 2008-137225

Patent document 2: Japanese Unexamined Patent Publication No. 2011-110872

SUMMARY

In the printers of patent documents 1 and 2, when the drawer unit (door frame) that can be drawn out of the cabinet is loaded into the cabinet, the rotating shaft of the ribbon roller (ink ribbon or ink bobbin) is connected to the driving unit by using the pressing member provided on the cabinet. However, in this construction, if the drawer unit is pushed into the cabinet without correctly installing the ribbon roller on the ribbon cassette, the connecting portion between the rotating shaft of the ribbon roller and the driving unit may break due to the pressing force.

Furthermore, in the printers of patent documents 1 and 2, the mechanism for relatively moving the ribbon roller along its axial direction is provided on both the cabinet and the drawer unit. In this case, since the amount of relative movement between the ribbon roller and the driving unit depends on the dimensional relationship between the member provided on the cabinet and the member provided on the drawer unit, it is difficult to enhance the accuracy of the movement. A further disadvantage is that the structure of the mechanism for relatively moving the ribbon roller becomes complex.

Accordingly, it is an object of the present invention to provide a printer in which the rotating shaft of a ribbon roller can be connected to its driving unit with high accuracy by using a mechanism simple in structure, while preventing breakage that may occur when connecting the rotating shaft to the driving unit.

The printer includes a cabinet, a drawer unit which can be drawn out of the cabinet, a ribbon roller on which a belt-like ink ribbon used for transferring to a recording sheet is wound, a driving unit which drives the ribbon roller for rotation by being connected to a rotating shaft of the ribbon roller when the drawer unit is loaded in the cabinet, and a disengaging member which is provided on the cabinet and which disengages the driving unit from the rotating shaft when the drawer unit is drawn out of the cabinet.

Preferably, the printer further includes a pressing member which presses the driving unit against the rotating shaft when the drawer unit is loaded in the cabinet.

Preferably, in the above printer, the driving unit is mounted to a moving member which is provided on the drawing unit so as to be movable along an axial direction of the rotating shaft inside the drawer unit, the moving member includes a protruding portion, and the disengaging member disengages the driving unit from the rotating shaft by contacting the protruding portion of the moving member and thereby moving the moving member when the drawer unit is drawn out of the cabinet.

Preferably, in the above printer, the disengaging member has a sloping face which guides the protruding portion of the moving member in a direction in which the moving member disengages from the ribbon roller when the drawer unit is drawn out of the cabinet.

Preferably, in the above printer, the protruding portion of the moving member is a lever which, when the drawer unit is drawn out of the cabinet, is rotated by contacting the disengaging member and thereby causes the moving member to move in a direction in which the moving member disengages from the ribbon roller.

According to the above printer, the rotating shaft of a ribbon roller can be connected to its driving unit with high accuracy by using a mechanism simple in structure, while preventing breakage that may occur when connecting the rotating shaft to the driving unit.

DESCRIPTION

Hereinafter, with reference to the drawings, a printer will be explained in detail. However, it should be noted that the technical scope of the present invention is not limited to embodiments thereof and includes the invention described in claims and equivalents thereof.

Figure 1:
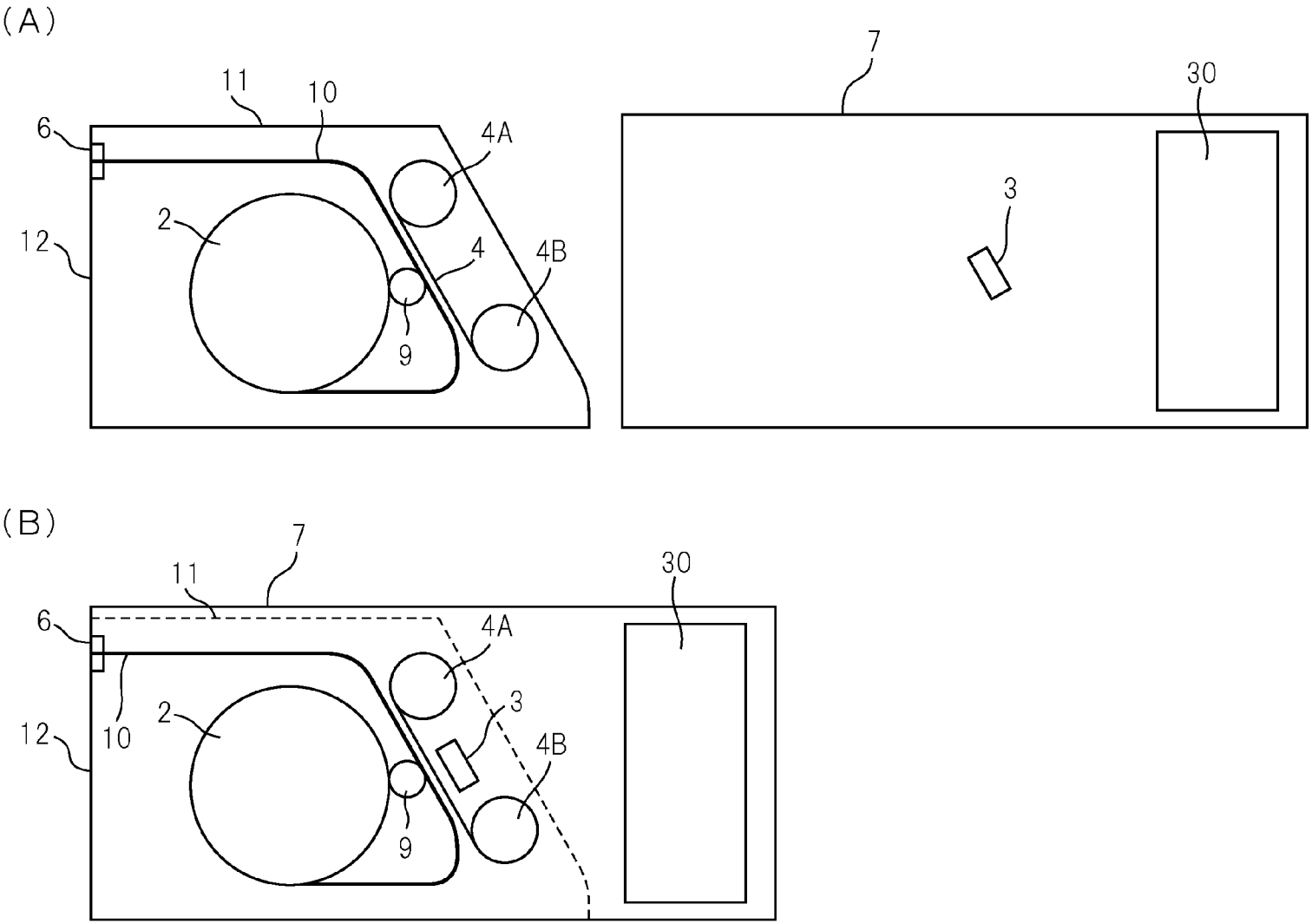
FIGS. 1(A) and (B) are diagrams schematically illustrating the construction of a printer 1.

FIGS. 1 (A) and 1 (B) are diagrams schematically illustrating the construction of a printer 1. The printer 1 includes a cabinet 7 which covers the outside of the printer 1, and a drawer unit 11 which is loaded in the cabinet 7 in a detachable manner. The drawer unit 11 is drawn out of the cabinet 7 by pulling an open lever (not shown) provided on a front side 12 of the printer 1. FIG. 1(A) shows the condition in which the drawer unit 11 is drawn out of the cabinet 7, and FIG. 1(B) shows the condition in which the drawer unit 11 is loaded in the cabinet 7. In the drawings, only the major component elements of the printer 1 are shown, and the other component elements are omitted from illustration.

The drawer unit 11 includes a roll paper holder 2, a ribbon supply roller 4A, a ribbon take-up roller 4B, a platen roller 9, and an exit port 6. On the other hand, the cabinet 7 includes a head 3 and a control unit 30. The division of the component elements of the printer 1 between the cabinet 7 and the drawer unit 11 is not limited to the one shown here, but may be determined as appropriate.

The printer 1 prints an image by moving a rolled recording sheet 10 back and forth relative to the head 3 and thereby sequentially transferring a plurality of color inks, for example, of yellow, magenta, and cyan, and an overcoat from an ink ribbon 4 onto the same area on the recording sheet 10.

The roll paper holder 2 holds thereon the recording sheet 10 wound into a roll. The roll paper holder 2 is driven to rotate around its center axis by a driving unit (not shown). As the roll paper holder 2 rotates, the recording sheet 10 is transported toward the exit port 6 by passing between the head 3 and the platen roller 9. The printed recording sheet 10 is cut off at a position just before the exit port 6 by means of a recording sheet cutting unit (not shown), and is discharged out of the printer 1 through the exit port 6.

The ribbon supply roller 4A and the ribbon take-up roller 4B each hold the ink ribbon 4 thereon. These rollers are driven to rotate around their center axes by respective driving units 31A and 31B (see FIG. 2). By thus driving the rollers, the ink ribbon 4 is unwound from the ribbon supply roller 4A, is transported by passing between the head 3 and the platen roller 9, and is wound on the ribbon take-up roller 4B. These rollers will hereinafter be referred to simply as the "ribbon rollers 4A and 4B."

The ink ribbon 4 is a belt-like sheet on which yellow, magenta, and cyan ink regions and an overcoat region, for example, are arranged repeatedly in the same order along its longitudinal direction. However, the ink ribbon 4 is not limited to a sheet containing such a plurality of color inks, but may be a sheet containing only a single color ink.

The head 3 is mounted so as to be movable relative to the platen roller 9, and during printing, the head 3 is pressed against the platen roller 9 with the ink ribbon 4 and the recording sheet 10 sandwiched therebetween. The color inks are transferred from the ink ribbon 4 onto the recording sheet 10 by heating of the head 3.

The control unit 30 is constructed from a microcomputer including a CPU and a memory, etc., and controls the entire operation of the printer 1. For example, the control unit 30 drives the head 3 in accordance with image data to be printed, and causes it to print an image on the recording sheet 10. Further, the control unit 30 controls the respective driving units for the roll paper holder 2 and the ribbon rollers 4A and 4B so as to transport the recording sheet 10 and the ink ribbon 4, respectively.

Figure 2:
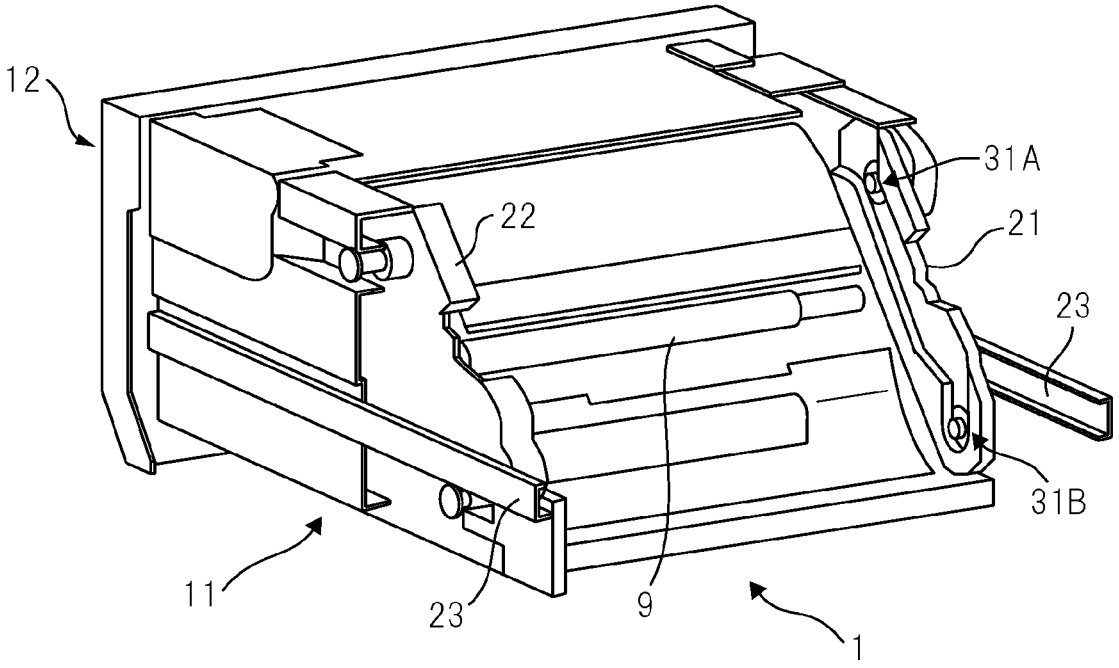
FIG. 2 is a perspective view of the drawer unit 11 as viewed from the left rear side.
Figure 3:
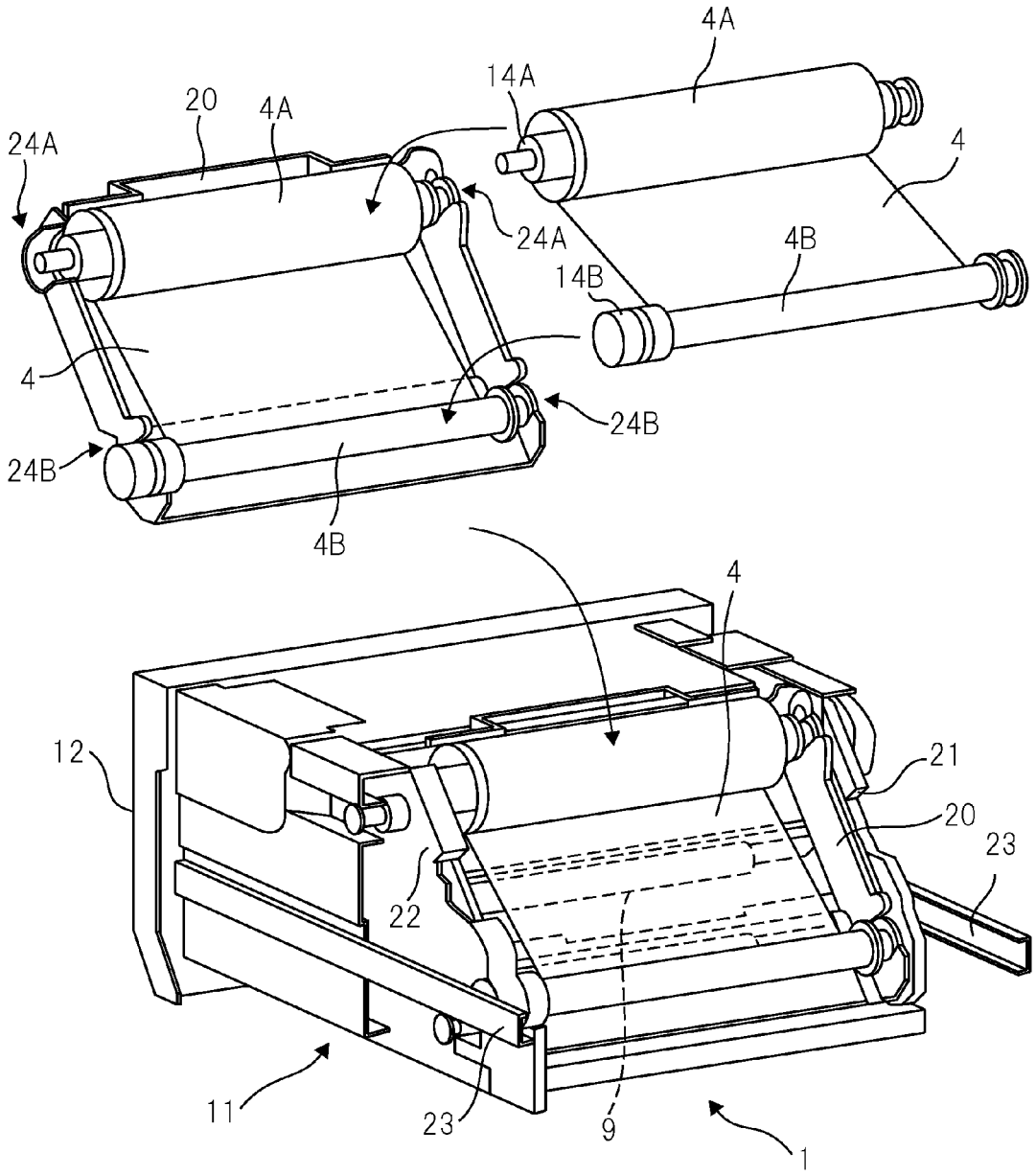
FIG. 3 is a diagram for explaining how the ribbon rollers 4A and 4B are installed onto the printer 1.

FIG. 2 is a perspective view of the drawer unit 11 as viewed from the left rear side. FIG. 3 is a diagram for explaining how the ribbon rollers 4A and 4B are installed onto the printer 1. FIG. 3 shows the ribbon rollers 4A and 4B, a ribbon cassette 20 on which the ribbon rollers 4A and 4B are mounted, and the drawer unit 11 viewed from the rear left side, i.e., the side opposite from the front side 12. FIG. 2 shows the drawer unit 11 before the ribbon cassette 20 is installed thereon.

As shown in FIG. 3, the ribbon cassette 20 has recessed portions 24A and 24B in its four corners; with the end portions of the roller shafts 14A and 14B placed in the recessed portions 24A and 24B, respectively, the ribbon rollers 4A and 4B are held so as to be rotatable and axially slidable along a limited distance. The drawer unit 11 is provided with guide portions 21 and 22 having grooves for fixedly holding both side walls of the ribbon cassette 20. With the drawer unit 11 drawn out of the cabinet 7 along rails 23 provided on both sides of the drawer unit 11 (i.e., in the open condition), the side walls of the ribbon cassette 20 are inserted in the grooves of the guide portions 21 and 22, thereby fixing the ribbon cassette 20 to the drawer unit 11. In this way, the ribbon rollers 4A and 4B are fixed to the drawer unit 11 by using the ribbon cassette 20. The ink ribbon 4 is run over the ribbon rollers 4A and 4B before the ribbon cassette 20 is installed on the printer 1.

As shown in FIG. 2, the driving units 31A and 31B are provided on one side of the drawer unit 11 at positions corresponding to the positions of the roller shafts 14A and 14B of the ribbon rollers 4A and 4B mounted on the ribbon cassette 20 fixed to the drawer unit 11. When the drawer unit 11 is loaded in the cabinet 7 (i.e., in the closed condition), the driving units 31A and 31B are connected to the respective roller shafts 14A and 14B (rotating shafts) of the ribbon rollers 4A and 4B to drive the ribbon rollers 4A and 4B for rotation.

Of the driving units 31A and 31B, at least the driving unit 31B for the ribbon take-up roller 4B need be driven by a driving motor, and the driving unit 31A of the ribbon supply roller 4A can be a driven shaft to which back tension is applied. In the description given herein, both the driving shaft which is actively driven by a driving motor and the driven shaft to which the back tension is applied are indiscriminately called the driving units.

When the ribbon cassette 20 with the ribbon rollers 4A and 4B placed thereon is fixed to the drawer unit 11 drawn out of the cabinet 7, the roller shafts 14A and 14B of the ribbon rollers 4A and 4B are not yet connected to the driving units 31A and 31B. As the drawer unit 11 drawn out is loaded into the cabinet 7, the driving units 31A and 31B are moved in the axial direction by the action of moving members 32 and thus the driving units 31A and 31B are connected to the respective roller shafts 14A and 14B. In this way, the ribbon rollers 4A and 4B are set ready to receive driving forces from the respective driving units 31A and 31B.

Figure 4:
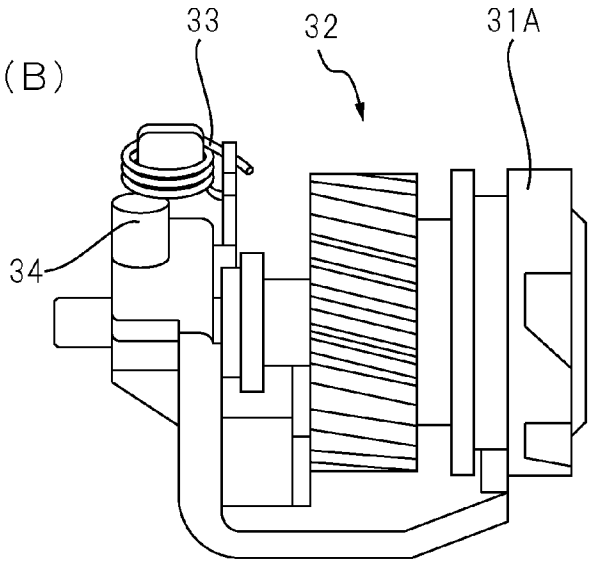
FIGS. 4(A) to (C) are perspective views of the moving member 32.
Figure 4:
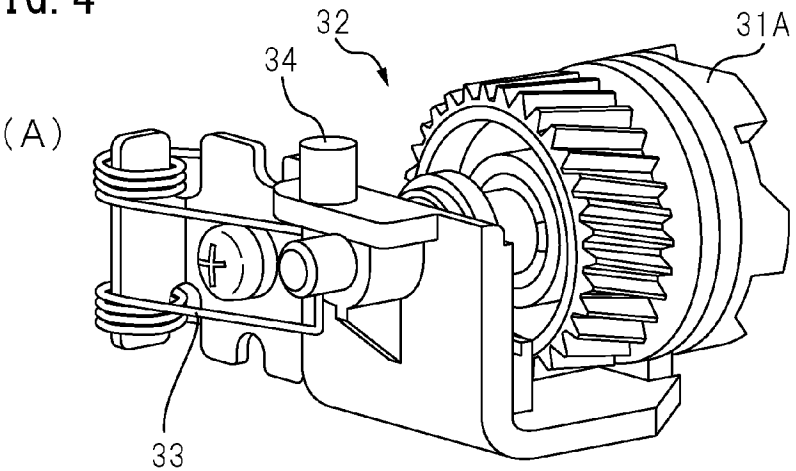
Figure 4:
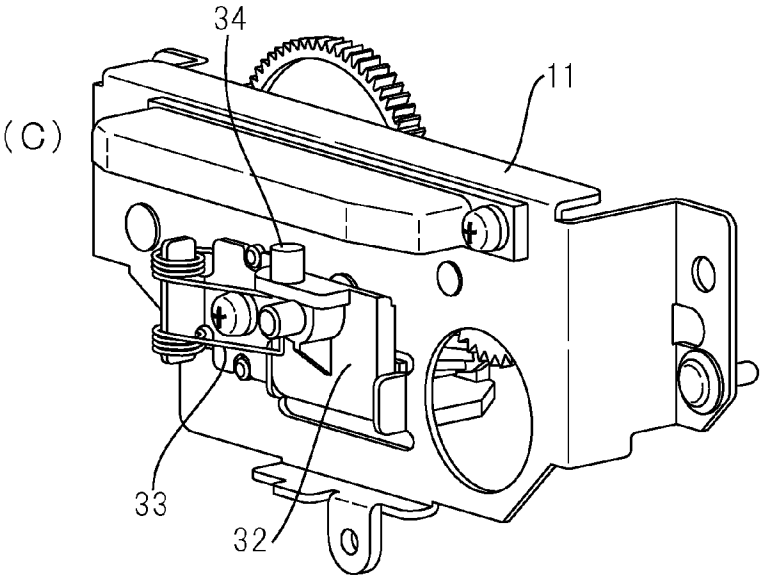
Figure 5:
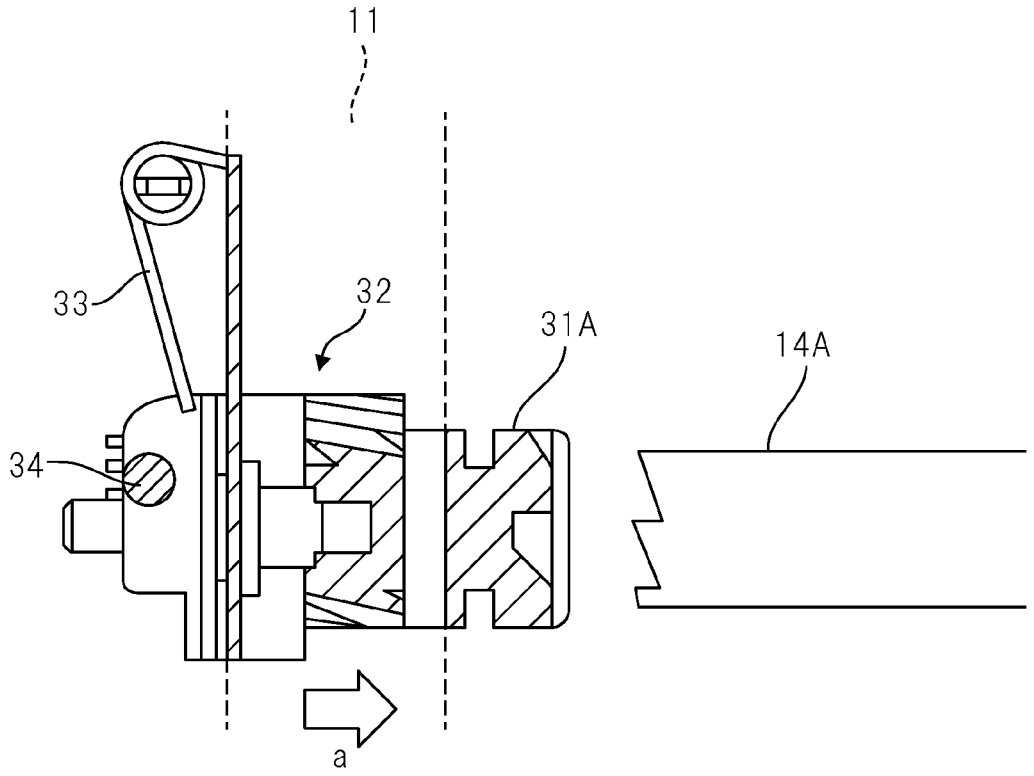
FIG. 5 is a horizontal cross-sectional view of the moving member 32.

FIGS. 4(A) to 4(C) are perspective views of the moving member 32. FIG. 5 is a horizontal cross-sectional view of the moving member 32. The right side in FIG. 5 corresponds to the inside of the drawer unit 11 where the roller shaft 14A is disposed, and the left side in FIG. 5 corresponds to the outside of the drawer unit 11. Dashed lines in FIG. 5 indicate a portion of the side wall of the drawer unit 11.

In the printer 1, two moving members 32 are provided, one for each of the driving units 31A and 31B of the ribbon rollers 4A and 4B. Since the two members are identical in structure, only the moving member 32 for the driving unit 31A will be described below.

The moving member 32 is provided on the drawer unit 11 by passing through the side wall of the drawer unit 11 in the direction of the roller shaft 14A of the ribbon roller 4A. The driving unit 31A is mounted to an end portion of the moving member 32 located inside the drawer unit 11. The moving member 32 moves along the axial direction of the roller shaft 14A of the ribbon roller 4A (along the leftward or rightward direction in the figure), depending on whether the drawer unit 11 is in the open condition or in the closed condition. Accordingly, the driving unit 31A is moved along the axial direction of the roller shaft 14A by means of the moving member 32.

A pressing member 33 is mounted to an end portion of the moving member 32 opposite from the end portion to which the driving unit 31A is mounted. The pressing member 33 is constructed, for example, from a spring. When the drawer unit 11 is loaded in the cabinet 7, a pressing force acting toward the inside of the drawer unit 11 (as indicated by an arrow a) is exerted on the moving member 32 by the pressing member 33. With this pressing force, the driving unit 31A is constantly pressed against the roller shaft 14A when the drawer unit 11 is loaded in the cabinet 7.

The end portion of the driving unit 31A, 31B and the end portion of the roller shaft 14A, 14B that faces the driving unit 31A, 31B are each provided with a ratchet having a toothed portion or a pawl. With the end portions engaging with each other, the driving unit 31A, 31B is connected to the roller shaft 14A, 14B so that the driving force from the driving unit 31A, 31B can be transmitted to the roller shaft 14A, 14B. When such ratchets are used, the transmission of the driving force can be switched between on and off by just moving the driving unit 31A, 31B relative to the roller shaft 14A, 14B along the axial direction.

Further, a protruding portion 34 protruding upward is provided on the end portion of the moving member 32 opposite from the end portion to which the driving unit 31A is mounted. When the drawer unit 11 is drawn out of the cabinet 7, the protruding portion 34 is guided in an outward direction (the direction opposite to the arrow direction a) so as to resist the pressing force of the pressing member 33 by a disengaging member 40 (see FIGS. 6(B) to 6(D)) provided on the cabinet 7. With this action of the protruding portion 34, the driving unit 31A is disengaged from the roller shaft 14A when the drawer unit 11 is drawn out of the cabinet 7. In the example of FIG. 4(A) to FIG. 5, the protruding portion 34 is shown as protruding upwardly of the moving member 32, but the protruding portion 34 may be formed so as to protrude downwardly of the moving member 32.

Figure 6:
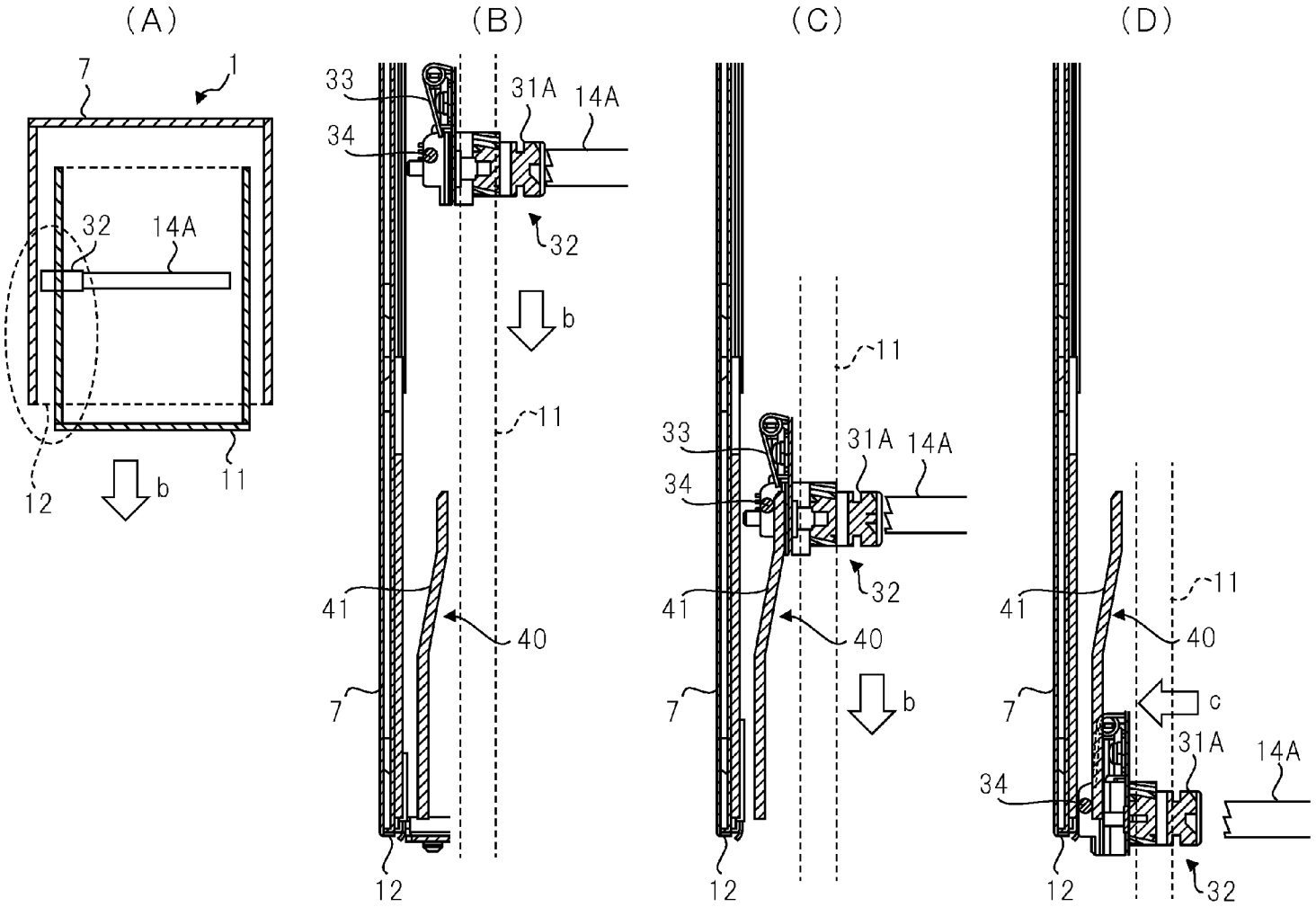
FIGS. 6(A) to (D) are diagrams for explaining the action of the moving member 32 in relation to the disengaging member 40.

FIGS. 6(A) to 6(D) are diagrams for explaining the action of the moving member 32 in relation to the disengaging member 40. FIG. 6(A) is a diagram showing the positional relationship between the cabinet 7, the drawer unit 11, the roller shaft 14A, and the moving member 32 when the entire construction is viewed from above the printer 1. FIGS. 6(B) to 6(D) are enlarged views of a portion encircled by a dashed line in FIG. 6(A). In these drawings, those component elements of the printer 1 that are not essential for the explanation are omitted from illustration. FIGS. 6(B) to 6(D) show the positional relationship between the moving member 32 and the disengaging member 40 when the drawer unit 11 is gradually drawn out of the cabinet 7.

As shown in FIGS. 6(B) to 6(D), the disengaging member 40 is provided on the cabinet 7 at an end of the front side 12 on the same side as the moving member 32 provided on the drawer unit 11. The disengaging member 40 has a shape extending from the front side 12 toward the side opposite the front side 12 and bent about halfway along its length, and has a sloping face 41 sloping relative to the drawing direction (indicated by an arrow b) of the drawer unit 11.

In the printer 1, two disengaging members 40 are provided on the cabinet 7 to correspond with the two moving members 32 provided on the drawer unit 11. Since the two members are identical in structure, only the disengaging member 40 used with the moving member 32 to which the driving unit 31A is attached will be described below.

FIG. 6(B) shows the positional relationship between the moving member 32 and the disengaging member 40 when the drawer unit 11 is drawn into the cabinet 7. As shown in FIG. 6(B), when the drawer unit 11 is loaded in the cabinet 7, the moving member 32 and the disengaging member 40 are not in contact with each other. The driving unit 31A is connected to the roller shaft 14A of the ribbon roller 4A because the moving member 32 is pressed against the roller shaft 14A by the pressing force of the pressing member 33.

FIGS. 6(C) and 6(D) show the positional relationship between the moving member 32 and the disengaging member 40 when the drawer unit 11 in the condition shown in FIG. 6(A) is drawn out in the arrow direction b and the two members are brought into contact with each other. As shown in FIGS. 6(C) and 6(D), when the drawer unit 11 is drawn out of the cabinet 7 in the arrow direction b, the disengaging member 40 contacts the protruding portion 34 of the moving member 32, causing the driving unit 31A to disengage from the roller shaft 14A. More specifically, when the drawer unit 11 is drawn out halfway, the protruding portion 34 of the moving member 32 contacts the sloping face 41 of the disengaging member 40. Then, as the drawer unit 11 is further drawn out of the cabinet 7, the protruding portion 34 is guided along the sloping face 41 in a direction (indicated by an arrow c) away from the roller shaft 14A. With this action of the protruding portion 34, the moving member 32 moves toward the side of the drawer unit 11 (in the arrow direction c) so as to resist the pressing force of the pressing member 33, so that the driving unit 31A is disengaged from the roller shaft 14A.

Therefore, when the drawer unit 11 is drawn out of the cabinet 7, the ribbon rollers 4A and 4B can be easily removed because the ribbon rollers 4A and 4B are simply sitting in the recessed portions 24A and 24B of the ribbon cassette 20.

Conversely, when the drawer unit 11 is pushed into the cabinet 7 along the rails 23 (in a direction opposite to the arrow direction b) from the condition shown in FIG. 6(D), the moving member 32 moves toward the roller shaft 14A (in a direction opposite to the arrow direction c) due to the pressing force of the pressing member 33 after passing the end of the disengaging member 40. Then, the driving unit 31A is again pressed against the roller shaft 14A and thus connected to the roller shaft 14A, as shown in FIG. 6(B). In this way, the roller shaft 14A is set ready to receive the driving force from the driving unit 31A.

Figure 7:
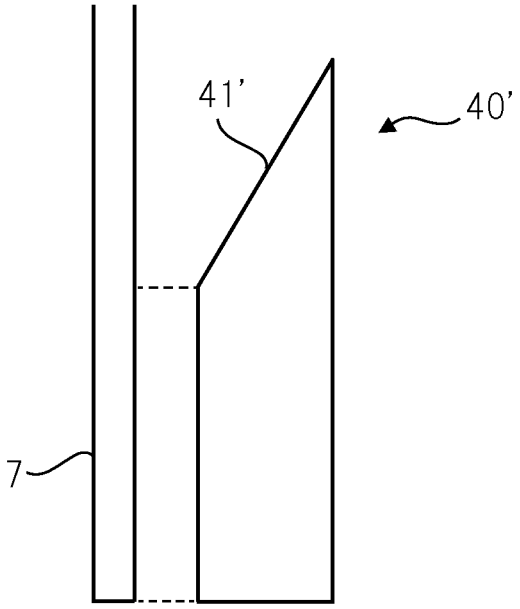
FIG. 7 is a plan view showing the shape of an alternative disengaging member 40'.

The shape of the disengaging member that can be used in the printer 1 is not limited to the particular one shown in FIGS. 6(B) to 6(D). FIG. 7 is a plan view showing the shape of an alternative disengaging member 40'. The disengaging member 40' shown in FIG. 7 is formed in the shape of a rectangle a portion of which is cut off, and has a sloping face 41' sloping relative to the drawing direction of the drawer unit 11. In this case also, when the protruding portion 34 of the moving member 32 contacts the sloping face 41', the disengaging member 40' works to guide the protruding portion 34 in a direction away from the roller shaft 14A, 14B as the drawer unit 11 is further drawn out of the cabinet 7.

As has been described above, in the printer 1, the driving unit 31A, 31B for the ribbon roller 4A, 4B is constantly urged in the direction of the roller shaft 14A, 14B by the action of the pressing member 33 so that when the drawer unit 11 is loaded in the cabinet 7, the driving unit 31A, 31B is connected to the roller shaft 14A, 14B. Then, when the drawer unit 11 is drawn out of the cabinet 7, the driving unit 31A, 31B is disengaged from the roller shaft 14A, 14B by the action of the disengaging member 40. When the drawer unit 11 drawn out is again loaded into the cabinet 7, the action of the disengaging member 40 ceases to exist and thus the driving unit 31A, 31B is again connected to the roller shaft 14A, 14B by the pressing force of the pressing member 33. That is, in the printer 1, because of the provision of the disengaging member 40, the driving unit 31A, 31B is disengaged from or connected to the roller shaft 14A, 14B in synchronism with the drawing/pushing of the drawer unit 11.

In the printer 1, when the drawer unit 11 is pushed into the cabinet 7, the only force acting on the roller shaft 14A, 14B is the pressing force exerted by the pressing member 33. Accordingly, if the drawer unit 11 is pushed into the cabinet 7 without correctly installing the roller shaft 14A, 14B on the ribbon cassette 20, the pushing force is not exerted directly upon the roller shaft 14A, 14B. This prevents the connecting portion between the roller shaft 14A, 14B and the driving unit 31A, 31B from being broken when the drawer unit 11 is pushed in. That is, in the printer 1, there is no need to provide a specific mechanism for preventing the breakage of the connecting portion.

Further, in the printer 1, the disengaging member 40 provided on the cabinet 7 works only when disengaging the driving unit 31A, 31B from the roller shaft 14A, 14B. Accordingly, the amount of relative movement between the roller shaft 14A, 14B and the driving unit 31A, 31B when connecting them together depends only on the moving member 32 provided on the drawer unit 11. As a result, the amount of relative movement between the roller shaft 14A, 14B and the driving unit 31A, 31B can be controlled accurately, compared with the case where the mechanism for relatively moving the roller shaft 14A, 14B along its axial direction is provided on both the cabinet 7 and the drawer unit 11. Furthermore, the printer 1 has the advantage that the construction is simplified, compared with the case where the mechanism for relatively moving the roller shaft 14A, 14B along its axial direction is provided on both the cabinet 7 and the drawer unit 11.

The disengaging member provided on the cabinet 7 need not necessarily has a sloping face as in the disengaging members 40 and 40'. In that case, the protruding portion 34 as the mechanism for disengaging the driving unit 31A, 31B from the roller shaft 14A, 14B is replaced, for example, by a lever, as will be described hereinafter.

Figure 8:
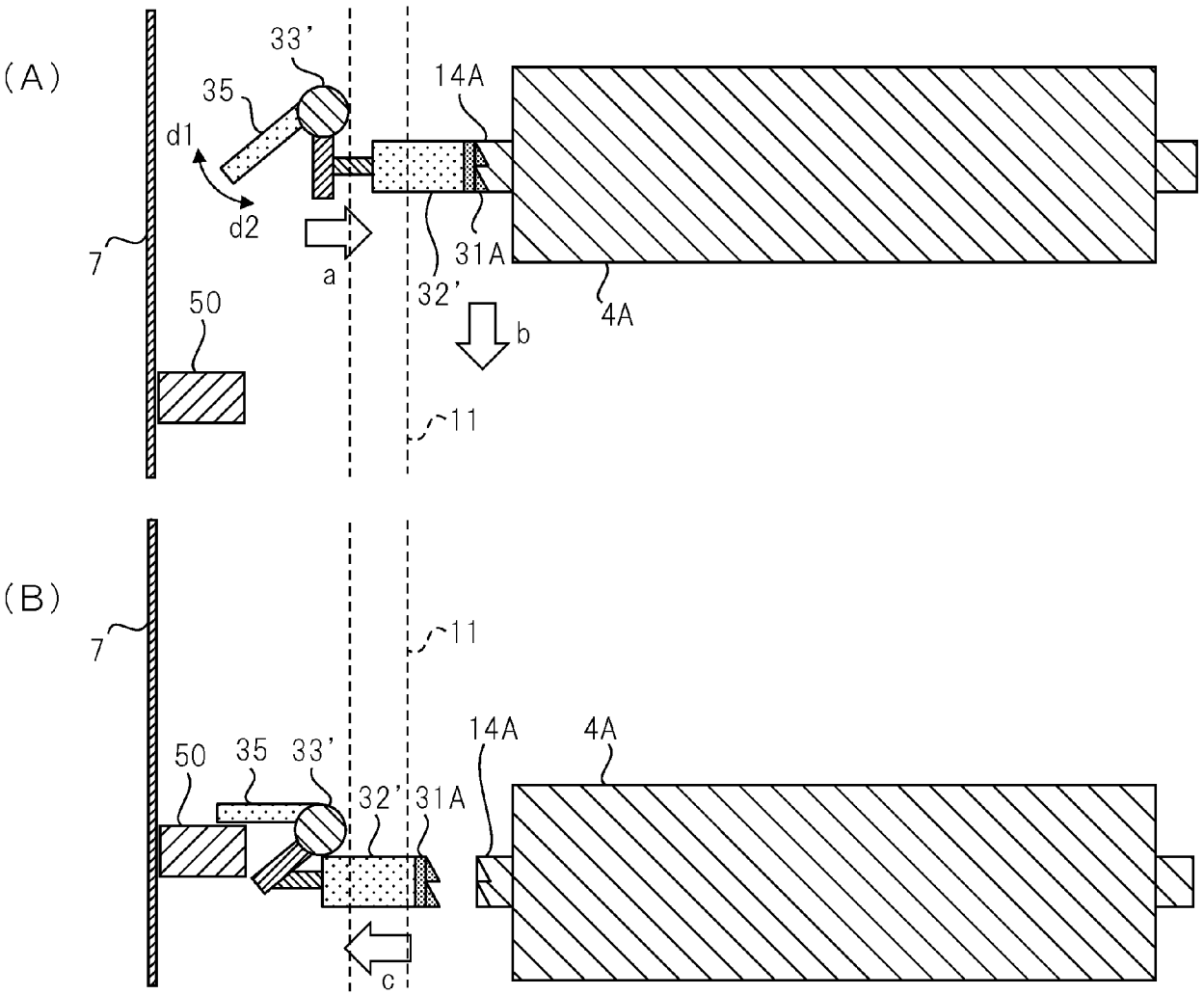
FIGS. 8(A) and (B) are diagrams for explaining the shape and action of an alternative moving member 32' in relation to an alternative disengaging member 50.

FIGS. 8 (A) and 8 (B) are diagrams for explaining the shape and action of an alternative moving member 32' in relation to an alternative disengaging member 50. The combination of the moving member 32' and the disengaging member 50 may be used in place of the combination of the moving member 32 and the disengaging member 40; in this case also, the printer actually includes two moving members 32' and two disengaging members 50, one for each of the driving units 31A and 31B of the ribbon rollers 4A and 4B. However, only the moving member 32' and the disengaging member 50 used with the driving unit 31A are shown in FIGS. 8(A) and 8(B).

The moving member 32', like the moving member 32, is provided on the drawer unit 11 by passing through the side wall of the drawer unit 11 in the direction of the roller shaft 14A of the ribbon roller 4A. The moving member 32' moves along the axial direction of the roller shaft 14A (along the leftward or rightward direction in the figure), depending on whether the drawer unit 11 is in the open condition or in the closed condition. The driving unit 31A is mounted to an end portion of the moving member 32' located inside the drawer unit 11, and is moved along the axial direction of the roller shaft 14A by means of the moving member 32.

A pressing member 33' is mounted to an end portion of the moving member 32' opposite from the end portion to which the driving unit 31A is mounted. Like the pressing member 33, the pressing member 33' is constructed, for example, from a spring, and applies a pressing force acting toward the inside of the drawer unit 11 (as indicated by an arrow a) to the moving member 32'. With this pressing force, the driving unit 31A is constantly pressed against the roller shaft 14A and connected to the roller shaft 14A via a ratchet when the drawer unit 11 is loaded in the cabinet 7.

The moving member 32' further includes a lever 35 which is attached, for example, to an end portion of the pressing member 33'. The lever 35 is one example of the protruding portion, and is rotatable on the connection point to the pressing member 33' as a fulcrum in an arrow direction d1 or d2 about the axis of rotation extending along the vertical direction of the drawer unit 11. As the drawer unit 11 is drawn out of the cabinet 7, the lever 35 comes into contact with the disengaging member 50 provided on the cabinet 7. The disengaging member 50 is provided on the cabinet 7 at an end of the front side on the same side as the moving member 32' provided on the drawer unit 11, but differs from the disengaging members 40 and 40' in that it does not have a sloping face.

FIG. 8(A) shows the positional relationship between the moving member 32' and the disengaging member 50 when the drawer unit 11 is loaded in the cabinet 7. In this condition, the moving member 32' and the disengaging member 50 are not in contact with each other, but the moving member 32' is pressed against the roller shaft 14A by the pressing force of the pressing member 33', so that the driving unit 31A is connected to the roller shaft 14A.

FIG. 8(B) shows the positional relationship between the moving member 32' and the disengaging member 50 when the drawer unit 11 in the condition shown in FIG. 8(A) is drawn out in the arrow direction b and the two members are brought into contact with each other. In this case, the lever 35 turns in the arrow direction d1 in FIG. 8(A) as it contacts the disengaging member 50. With this action of the lever 35, the moving member 32' moves in the arrow direction c so as to resist the pressing force of the pressing member 33', so that the driving unit 31A is disengaged from the roller shaft 14A of the ribbon roller 4A.

Conversely, when the drawer unit 11 is pushed into the cabinet 7 (in a direction opposite to the arrow direction b) from the condition shown in FIG. 8(B), the lever 35 turns in the arrow direction d2 in FIG. 8(A) as it leaves the disengaging member 50. At this time, the moving member 32' moves in the arrow direction a due to the pressing force of the pressing member 33', as shown in FIG. 8(A), and the driving unit 31A is again connected to the roller shaft 14A.

As has been described above, using the disengaging member 50 that does not have a sloping face, the moving member 32' may be moved in a direction away from the roller shaft 14A, 14B by operating the lever 35 in synchronism with the drawing action of the drawer unit 11 when the drawer unit 11 is drawn out of the cabinet 7.

Alternatively, a motor or like unit for effecting disengagement may be provided in place of the disengaging member 40, 40', 50, and using the power of such a motor unit, the driving unit 31A, 31B may be disengaged from the roller shaft 14A, 14B when the drawer unit 11 is drawn out. Further alternatively, instead of providing a separate motor unit, a motor unit used, for example, for the recording sheet cutting unit in the printer 1 may also be used as a unit for effecting the disengagement, and using the power of such a motor unit, the driving unit 31A, 31B may be disengaged from the roller shaft 14A, 14B when the drawer unit 11 is drawn out.

REFERENCE SIGNS LIST

1 printer
2 roll paper holder
3 head
4A, 4B ribbon roller
7 cabinet
11 drawer unit
14A, 14B roller shaft
20 ribbon cassette
31A, 31B driving unit
32, 32' moving member
33, 33' pressing member
34 protruding portion
35 lever
40, 40', 50 disengaging member

What is claimed is:

1. A printer comprising:
a cabinet;
a drawer unit which can be drawn out of the cabinet;
a ribbon roller on which a belt-like ink ribbon used for transferring to a recording sheet is wound;
a driving unit which drives the ribbon roller for rotation by being connected to a rotating shaft of the ribbon roller when the drawer unit is loaded in the cabinet;
a pressing member which provides a force in a direction of engagement with the rotating shaft; and
a disengaging member which is provided on the cabinet and which disengages the driving unit from the rotating shaft when the disengaging member is in contact with a moving member, in a state where the drawer unit is drawn out of the cabinet.

2. The printer according to claim 1, wherein
the driving unit is mounted to the moving member which is provided on the drawing unit so as to be movable along an axial direction of the rotating shaft inside the drawer unit,
the moving member includes a protruding portion, and
the disengaging member disengages the driving unit from the rotating shaft by contacting the protruding portion of the moving member and thereby moving the moving member when the drawer unit is drawn out of the cabinet.

3. The printer according to claim 2, wherein the disengaging member has a sloping face which guides the protruding portion of the moving member in a direction in which the moving member disengages from the ribbon roller when the drawer unit is drawn out of the cabinet.

4. The printer according to claim 2, wherein the protruding portion of the moving member is a lever which, when the drawer unit is drawn out of the cabinet, is rotated by contacting the disengaging member and thereby causes the moving member to move in a direction in which the moving member disengages from the ribbon roller.

* * * * *